United States Patent [19]

Schneider et al.

[11] Patent Number: 5,009,034

[45] Date of Patent: Apr. 23, 1991

[54] CLOSURE SUPPORT

[75] Inventors: Alfred Schneider, Kreutzal; Horst Loos; Karl H. Fischbach, both of Freudenberg, all of Fed. Rep. of Germany

[73] Assignee: Siegenia-Frank KG, Siegen, Fed. Rep. of Germany

[21] Appl. No.: 468,705

[22] Filed: Jan. 23, 1990

[30] Foreign Application Priority Data

| | | | |
|---|---|---|---|
| Jan. 24, 1989 | [DE] | Fed. Rep. of Germany | 3901944 |
| Mar. 23, 1989 | [DE] | Fed. Rep. of Germany | 8903678 |
| Jun. 22, 1989 | [DE] | Fed. Rep. of Germany | 3920360 |

[51] Int. Cl.[5] ..... E05D 15/52

[52] U.S. Cl. ..... 49/192; 49/386

[58] Field of Search ..... 49/386, 387, 396, 381, 49/192, 70

[56] References Cited

U.S. PATENT DOCUMENTS

| | | | |
|---|---|---|---|
| 1,328,168 | 1/1920 | Kroon . | |
| 1,864,164 | 6/1932 | Aldeen . | |
| 3,722,142 | 3/1973 | Anderberg et al. . | |
| 4,158,271 | 6/1979 | Barry | 49/386 |
| 4,602,457 | 7/1986 | Kreusel | 49/192 |

FOREIGN PATENT DOCUMENTS

| | | |
|---|---|---|
| 26176 | 2/1884 | Fed. Rep. of Germany . |
| 329280 | 11/1920 | Fed. Rep. of Germany . |
| 3834388 | 10/1933 | Fed. Rep. of Germany . |
| 588193 | 11/1933 | Fed. Rep. of Germany . |
| 1913993 | 1/1965 | Fed. Rep. of Germany . |
| 2508174 | 9/1976 | Fed. Rep. of Germany . |
| 3519988 | 12/1986 | Fed. Rep. of Germany . |
| 1117003 | 3/1956 | France . |
| 218319 | 3/1942 | Switzerland . |
| 496829 | 12/1938 | United Kingdom . |

*Primary Examiner*—Philip C. Kannan

*Attorney, Agent, or Firm*—Blodgett & Blodgett

[57] ABSTRACT

A window or a door with a panel (1) mounted on a fixed frame (2) on or near an upright boundary edge by hinge fittings (5, 6). To relieve the hinge fittings (5, 6) of the vertical component of the force of weight or load of the panel (3), a brace (11) is provided, engaging with the panel (3) on the one hand in the area of the hinge fittings (5, 6) and on the other hand, anchored to the fixed frame (2) against the force of weight or direction of load of the panel (3). The brace is provided above, but adjacent to, a lower corner hinge.

11 Claims, 7 Drawing Sheets

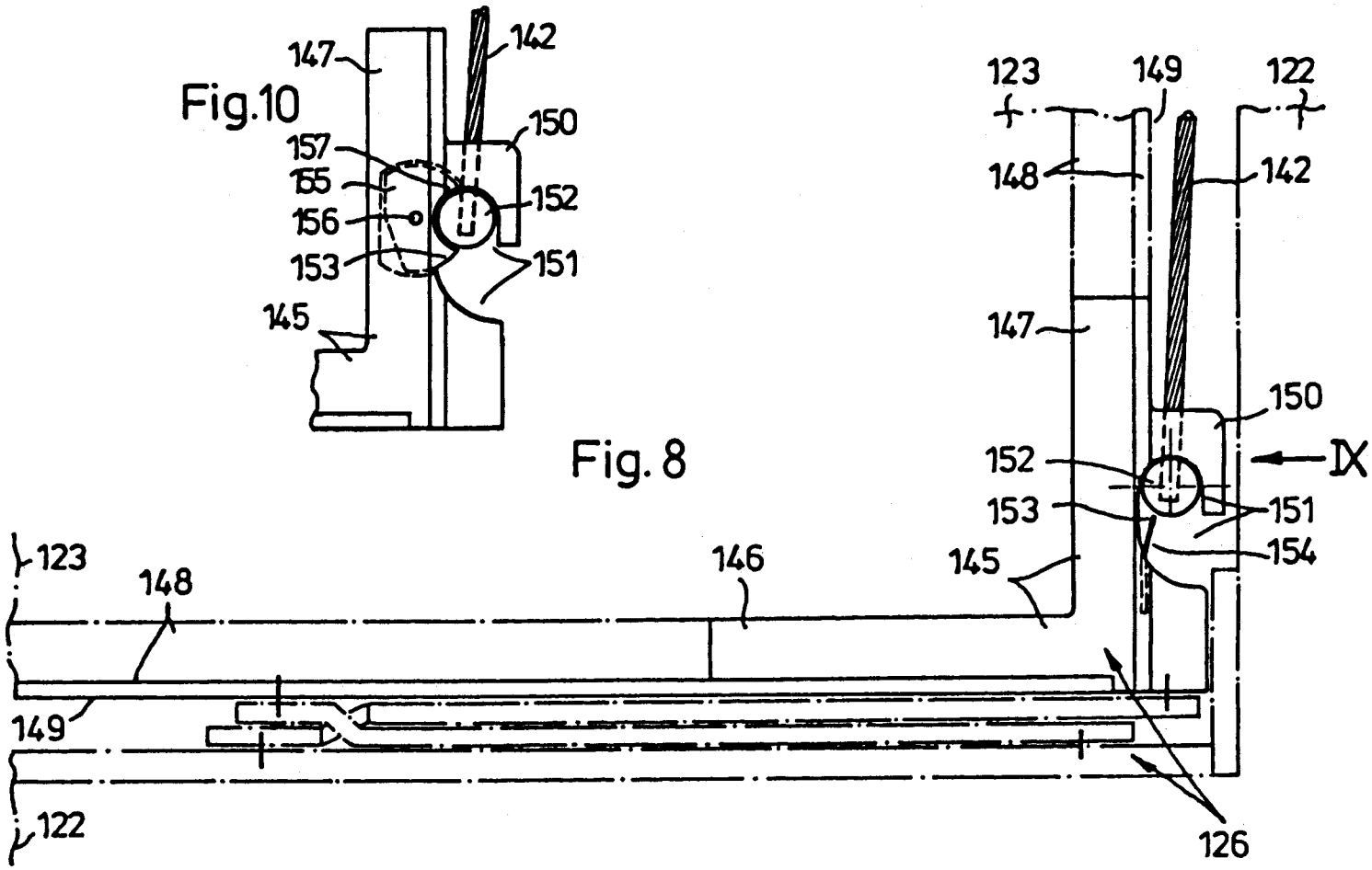
Fig. 8
Fig. 10
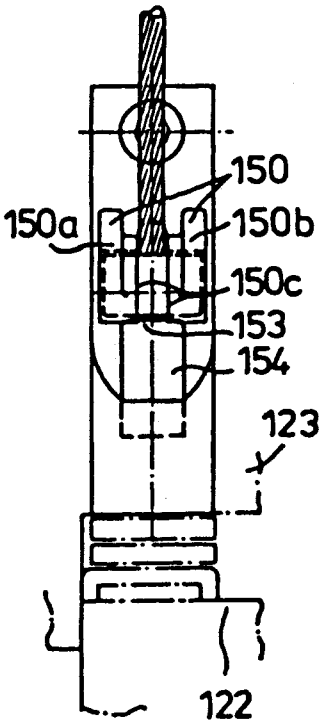
Fig. 9

CLOSURE SUPPORT

FIELD OF THE INVENTION

This invention relates to a closure (a window or a door) with a panel mounted on a fixed frame by hinge fittings on or near an upright boundary edge.

BACKGROUND OF THE INVENTION

Such windows or doors are known and are equipped either with a rotating panel or a tilt panel The hinge fittings connected to the fixed frame in such closures can be supported visibly in front of the face of the fixed frame on the opening side. On the other hand, it is also possible to use hinge fittings that have a completely hidden position when installed in a chamber between the grooves of the panel and the fixed frame. In either case, the stresses resulting from the weight or load of the panel in these known windows or doors is transmitted fully to the fixed frame through the intermediate hinge fittings.

Since the panels of modern window or door designs may have a relatively large weight (for example up to 130 kg,) the hinge fittings connecting them to the fixed frame are exposed to correspondingly high stresses. This leads to considerable wear on the slide bearing surfaces (oriented normal to the axial direction of the hinge and supported on one another and against one another in the manner of a thrust bearing,) if provision is not made constantly for perfect lubrication. Furthermore, permanent deformations can occur in the hinge fittings themselves or in areas of their connection to the panel and the fixed frame. This later gives rise to impairment of the proper operation of the window or door.

In the case of support fittings designed as hinges for windows and doors, the support surfaces absorbing or transmitting the axial bearing forces (as shown for example in German Registered Design No. 19 13 993, French Pat. No. 11 17 003, and Swiss Pat. No. 218 319,) are set up so that their operating planes are accessible from the outside, or they are provided with a long-term supply of lubricants. In these known hinges, however, there is still the drawback that heavy panel weights may lead to permanent deformation of the hinge parts themselves or their points of connection to the fixed frame and the panel.

It is the primary object of this invention to provide a mechanism by which the hinge fittings connecting the panel to the fixed frame can be substantially relieved of the weight of the panel acting in the axial direction in windows or doors of the type described initially. This can even be accomplished by retrofitting, by simple means, without thereby impairing the mechanism of action of the particular hinge fittings whose use is necessitated by the system set up.

SUMMARY OF THE INVENTION

The invention is characterized by a brace engaging with the panel in the area of the hinge fittings on the one hand, and on the other hand anchored to the fixed frame against the force of weight or direction of load of the panel.

In the simplest and at the same time also the most desirable case, the brace can be hung directly by its upper end on the fixed frame, while at the same time it engages at its lower end with the panel. In this case, when the brace is kept constantly under tight tension, the vertical component of the force of gravity or load of the panel is transmitted directly to the fixed frame. In this way the hinge fittings only have to absorb stresses that result from horizontal components of the weight or load of the panel, which stresses are oriented essentially perpendicularly to the hinge axes.

In another aspect of the invention a counterforce acts or the brace relative to its support on the fixed frame, for example in the form of a counterweight counterbalancing the weight of the panel, or in the form of an appropriately stressed spring. To accommodate such additional elements, however, a corresponding installation space has to be available. This is not always available in ordinary window and door constructions.

In the case of windows or doors that are equipped with a tilt panel, that is supported on the fixed frame by a sc-called "corner hinge" at the intersection between its lateral, upright hinge axis and its lower, horizontal hinge axis, it is essential according to the invention for the brace to be installed between the panel and the fixed frame above, but near, the lower corner hinge. This provides in a simple way for the hinge fittings constituting the lower corner hinge to be relieved to the greatest extent of the weight of the panel, not only in the closed position and in the rotated open position of the panel, but also in its tilted open position.

It is also preferred for the brace to be comprised of a rope or cable, or to consist optionally of a Bowden wire. A brace of such a design not only needs little installation space, but it can be adapted easily to the motions of the panel relative to the fixed frame which occur during the opening and closing of the window or door, while maintaining its action. It is particularly desirable for the brace of the invention to be hidden in the air space between the grooves of the panel and frame. For flexible usefulness it is desireable, for the brace to be designed with at least limited length adjustability.

As an alternate to cable, it is also possible to have the brace consist of a rigid tension rod whose ends engage with the panel and the fixed frame by universal joint or ball joint connectors.

It is also within the scope of the invention to place the brace under a counterforce relative to the support on the fixed frame, for example, by a counterweight counterbalancing the weight of the panel, or an appropriately stressed spring. The brace can be carried around the stationary side wall on the fixed frame (for example by means of a pulley) and can be placed under tensile stress by the counterforce, for example the counterweight.

In a further aspect of the invention comprises at least one ribbon-like material susceptible to torsion, particularly spring steel strip, as the brace. In this case, it is desirable for the ribbon-like material to have a width that corresponds to a multiple, for example about sixteen to twenty times, of its thickness. In the closed position of the panel resting on the fixed frame the ribbon-like material extends over its entire length with its wider surface and is at least approximately parallel to the surfaces of the groove, or perpendicular to the principal planes of the panel and fixed frame.

For windows or doors with rotary panels one can install the brace between the panel and the fixed frame at practically any level in the area of the hinge fittings. However, in windows or doors with tilt panels, as has been already mentioned, it is of considerable importance for the brace to engage with the panel at least in the vicinity of the lower corner hinge.

In practice, it is necessary to hold and guide the panels with consistent functional reliability relative to the fixed frame through the hinge fittings. However, it also proves to be important to arrange the cable between the fixed frame and the panel in such a way that the panel can be brought into holding engagement easily and reliably when the panel is being hung, and so that it can also be easily disengaged when the panel is being removed. Therefore, it is also important that at least the connecting mechanism between the brace and the panel be held in its operating position against its weight by structurally simple means, so that easy and manually simple engagement and disengagement of the connecting elements is provided for. This objective is reached according to a further aspect of the invention by the fact that the hinge part on the panel side has a hook shoulder projecting (like a bracket) beyond the boundary edge of the vertical member of the panel, with an angular slot open to the side at its lower end. The hook shoulder has two hook sections parallel to the plane of the panel and separated from one another by a spacing gap. The brace has a block-shaped enlargement at its lower end whose cross sectional dimension matches the width of the angular slot; the spacing gap constitutes a receptacle for the brace. The particular advantage of this construction consists of the fact that the coupling elements acting jointly can be of relatively large and rugged design, and this makes possible easy handling during the installing and removal procedures. However, it is also preferred pursuant to the invention for the block-shaped enlargement to consist of a cylindrical or spherical body in which the brace is permanently or detachably anchored. Detachable anchoring in this case can be accomplished, for example, using a clamping screw that has such a length and position in the block-shaped enlargement that it is not accessible to the hinge part on the panel side when the brace is hung.

In a further aspect of the invention the hinge part on the panel side comprises an angled piece that can be inserted into a groove profiled in steps in the circumferential groove surface by means of two angled legs and located in the vicinity of the corner of the panel.

It has turned out to be particularly desirable during the process of hanging the panel to couple the brace with the panel first, and only then to proceed with the hanging of the panel in the hinge fittings. The brace can then transmit the weight of the panel to the fixed frame, while the panel is being connected to the hinge fittings. When a rope or cable is used as the brace, it is possible to provide a loop on its end facing the panel that can be hung on a supporting peg provided on the hinge part on the panel side, and having an enlarged head or a circumferential groove. However, since the loop is narrowed under the action of the weight of the panel, there can be difficulties when the brace has to be disengaged from it when it is necessary to remove the panel.

According to a further aspect of the invention, a cam-shaped tapered projection can be associated with the angular slot of the hook shoulder in the area of the opening pointing toward the side (or just above it) to prevent the brace from unintentionally disengaging from the hinge part on the panel side. In the simplest case, the tapered projection pursuant to the invention can consist of a spring tab or a latch snap that is provided on the hinge part on the panel side. Finally, it is also considered to be within the scope of the invention for the tapered projection to be located on the free end of the one lever arm of a two-armed lever mounted to pivot in the hinge part on the panel side. The lever carries a cam point at the free end of its other lever arm that extends into the angular slot of the hook shoulder when the tapered projection is not engaged in the angular slot of the hook shoulder.

BRIEF DESCRIPTION OF THE DRAWINGS

The invention is best understood, however, by reference to some of its possible structural forms as shown in the attached drawings, in which:

FIG. 8 shows, on a larger scale, the cutaway area identified as VIII in FIG. 7, as a detailed illustration, FIG. 9 is a view in the direction of the arrow IX of FIG. 8, and FIG. 10 shows the portion of FIG. 8 essential to the invention in modified structural design.

DESCRIPTION OF THE PREFERRED EMBODIMENTS

Figure 1:
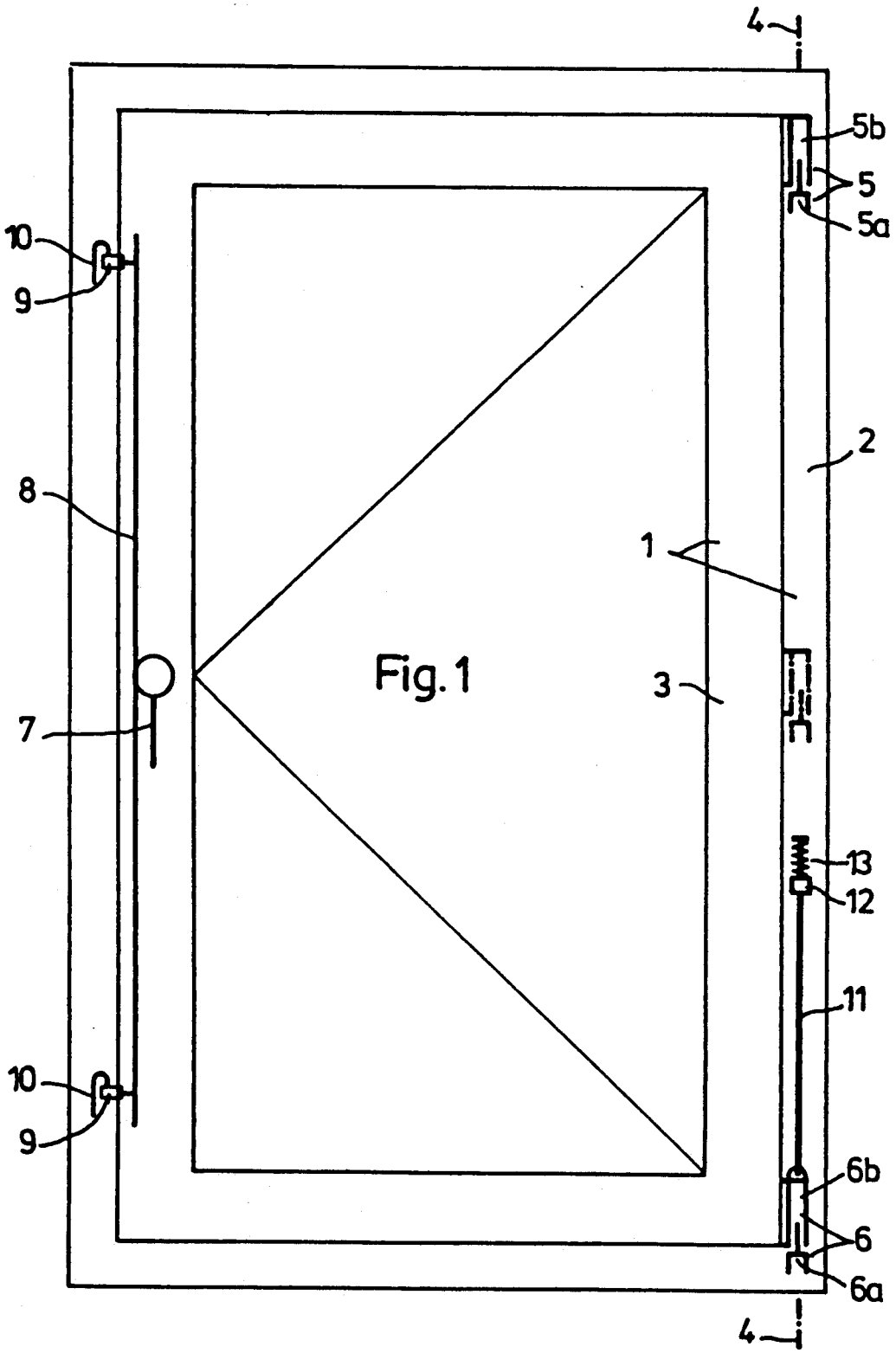
FIG. 1 shows a window or a door in which the panel is hung as a rotary panel on the fixed frame and the hinge fittings are mounted and are visible in front of the room-side face of the fixed frame.

FIG. 1 of the drawing illustrates a window or a door 1 that consists, in the usual way, of a fixed frame 2 and a panel 3. The panel 3 here is arranged on the fixed frame 2 and is movable around a vertical axis 4-4 into a rotated open position (and therefore constitutes a so-called rotary panel.) At least an upper hinge 5 and a lower hinge 6 are provided to mount the panel 3 on the fixed frame 2, with the two hinges 5 and 6 being mounted to rest and be visible in front of the room-side face of the fixed frame beside an vertical panel member, for example the right panel member.

The hinge parts **5*a* and 6*a* fastened to the fixed frame, comprise so-called "pin" hinge parts, while the hinge parts 5*b* and 6*b* fastened to the panel each comprise "sleeve" hinge parts. The sleeve hinge parts 5*b* and 6*b* are put onto the pin hinge parts 5*a* and 6*a* from the top and thus constitute the hinges 5 and 6 which are aligned with the vertical axis 4-4. The panel 3 can thus be moved from its closed position into the rotated open position or the reverse relative to the fixed frame 2**.

A connecting rod fitting 8 that can be operated by an operating handle 7 is provided on the panel 3, and makes it possible to lock the panel 3 in the closed position or to unlock it relative to the fixed frame 2 by means of locking cogs 9 and associated locking catches 10.

In the area of the hinge fittings formed by the hinges 5 and 6, there is a brace 11 engaged on one end with the panel 3 and anchored on the other end on the fixed frame 2 against the weight or load direction of the panel 3. It is aligned at least approximately parallel to the vertical axis 4-4. This brace 11 can be a rod-shaped tie rod. Preferably, however, it comprises a rope or a cable or it consists of a Bowden wire. As shown in FIG. 1, the brace 11 may be hung by its upper end on the fixed frame 2 in a stationary support 12, while its lower end engages with the panel 3 by a connection to the upper end of the sleeve hinge part 6*b* of the lower hinge 6.

The effective length of the brace 11 between the support 12 and the sleeve hinge part 6*b* of the lower hinge 6 is made or is adjusted so that it can fully absorb the vertical load component in the area of the axis 4-4 resulting from the weight of the panel 3. This avoids the necessity of the support surfaces of the panel hinge parts 5*b* and 6*b* being in contact with opposite support surfaces of the frame hinge parts 5*a* and 5*b* and absorbing axial forces in the manner of thrust bearings. Thus, the hinges 5 and 6 can act as pure pivot bearings between the panel 3 and the fixed frame relieved of axial forces. The hinges have to absorb only the force effects resulting from the horizontal components of the weight or load of the panel 3, which are directed essentially perpendicular to the axis 4-4.

It may be beneficial if the effective length of the brace 11 between its stationary support 12 on the fixed frame 2 and the point of engagement on the panel 3 can be varied smoothly within certain limits, for example by using a screw member or by cams. The brace can then be placed under tight tensile stress at any time under the action of the weight of the panel 3 in the direction of the axis 4-4, and the support surfaces between the interactive hinge parts 5*a*, 5*b* and 6*a*, 6*b* can thereby be relieved of the weight forces of the panel 3. However, it is also possible to support the brace 11 by an intermediate spring element 13 on the stationary support 12 of the fixed frame 2, and thus to adjust the prestress force of this spring element 13 to the particular weight of the panel 3 so that its vertical load component does not have to be absorbed by the frame hinge parts 5*a* and 6*a*, but instead is transmitted directly from the brace 11 to the fixed frame 2. It is also possible to bring about an equivalent relieving action for the hinges 5 and 6 by providing that the brace 11 on t he fixed frame 2 is guided around the stationary support 12, for example by a pulley, and to be placed under tensile stress by a counterweight acting on it. This counterweight can optionally be held in cavities or chambers made in the vertical frame element.

Figure 2:
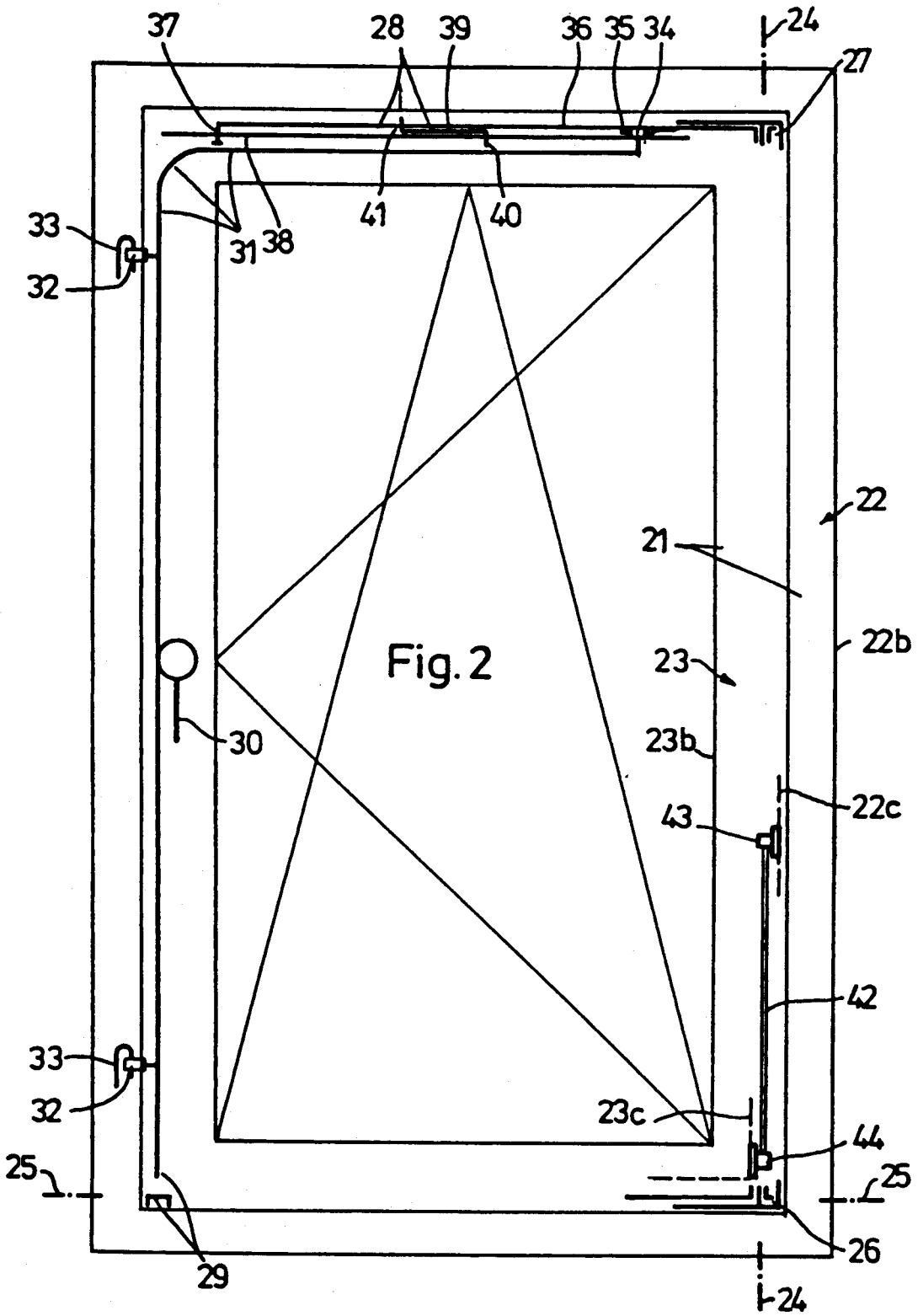
FIG. 2 is a schematic illustration similar to FIG. 1 of a window or a door in which the panel is fastened as a tilt panel to the fixed frame and the hinge fittings are hidden between the grooves of the panel and frame.

FIG. 2 of the drawing shows a window or a door 21 that comprises a fixed frame 22 and a panel 23. The panel 23 is arranged to move optionally around a vertical axis 24-24 into a rotated open position, or around a bottom horizontal axis 25-25 into a tilted open position. The panel 23 for this purpose is supported on the fixed frame 22 by a corner hinge or a tilt corner bearing 26 at the point of intersection of the two hinge axes 24-24 and 25-25. Furthermore, there is a hinge 27 of a ventilation mechanism 28 at the top between the panel 23 and the fixed frame 22, and there is a tilt lock 29 between the bottom closure corner of the panel 23 and the fixed frame 22.

A connecting rod fitting 31 adjustable by an operating handle 30 is provided in the panel 23 so that the panel 23 in the closed position can be locked to and unlocked from the fixed frame 22 by locking cogs 32 and associated locking catches 33. The connecting rod fitting 31 can also be designed so that it can be used to engage or disengage a coupling 34, 35 between the panel 23 and the ventilator mechanism 28, and between the panel and the tilt lock 29. In both the closed position and in the rotated open position of the connecting rod fitting 31, the coupling 34, 35 between the panel 23 and the ventilator mechanism 28 is in its engaged position. In the tilted open position of the connecting rod fitting 31, on the other hand, the coupling 34, 35 is disengaged. The tilt lock 29 is in the disengaged position when the connecting rod fitting 31 is in its closed position and its rotated open position, while it is engaged in the tilted open position.

The ventilation mechanism 28 is a so-called "supporting" ventilation mechanism, i.e., it is suitable for holding the weight of the panel and transmitting it to the upper hinge 27 on the frame side in the closed and rotated open position of the connecting rod fitting 31. For this purpose, the ventilation mechanism 28 has a ventilator arm 36 mounted to pivot in the hinge 27 on the frame side, which is engaged at its other end through a press fit pin 37 both to pivot and to move longitudinally in a slip guide 38 that extends essentially parallel to the upper edge of the panel 23. The ventilation mechanism 28 also has a supplementary arm 39, which is hinged to pivot only on the panel 23 through a pivot pin 40, on the one hand, but on the other hand is connected to the ventilator arm 36 to pivot exclusively through a pivot pin 41. The ventilation mechanism 28 is kinematically designed so that when the panel 23 is tilted open, it holds the upper panel element oriented parallel to the upper element of the fixed frame in every possible tilted position.

In distinction from the window or door according to FIG. 1, in the case of the window 21 according to FIG. 2 the panel 23 is held on the fixed frame 22 by hinge fittings that are completely hidden in the air space between the grooves of the panel 23 and the fixed frame 22. Hinge fittings whose principle of action is based on the pantograph or micrograph principle, for example, can be used to make both the corner hinge or tilt corner bearing 26 and the hinge 27 (for example, refer to German Pat. Exposition No. 25 08 174 and German Pat. No. 35 19 988).

To relieve the corner hinge or tilt corner bearing 26 of the vertical component of the weight or load of the panel 23, a brace 42 is also used in the window or door 21 of FIG. 2. It acts in the direction of the vertical hinge axis 24-24, and for this purpose it is hung by its upper end on a stationary support 43 on the fixed frame 22, while its lower end engages in a support 44 located on the panel 23. In this case, the brace 42 with its supports 43 and 44 is actually installed completely above but still very close to the bottom corner hinge or tilt corner bearing 26 between the panel 23 and the fixed frame 22, as seen clearly in FIG. 2. The brace 42 in FIG. 2 can basically have the same design and mechanism of action as the brace 11 in FIG. 1. However, in contrast to the brace 11 of FIG. 1, the brace 42 of FIG. 2 is hidden in the air space between the grooves of the panel 23 and the fixed frame 22 of the window 21.

Figure 3:
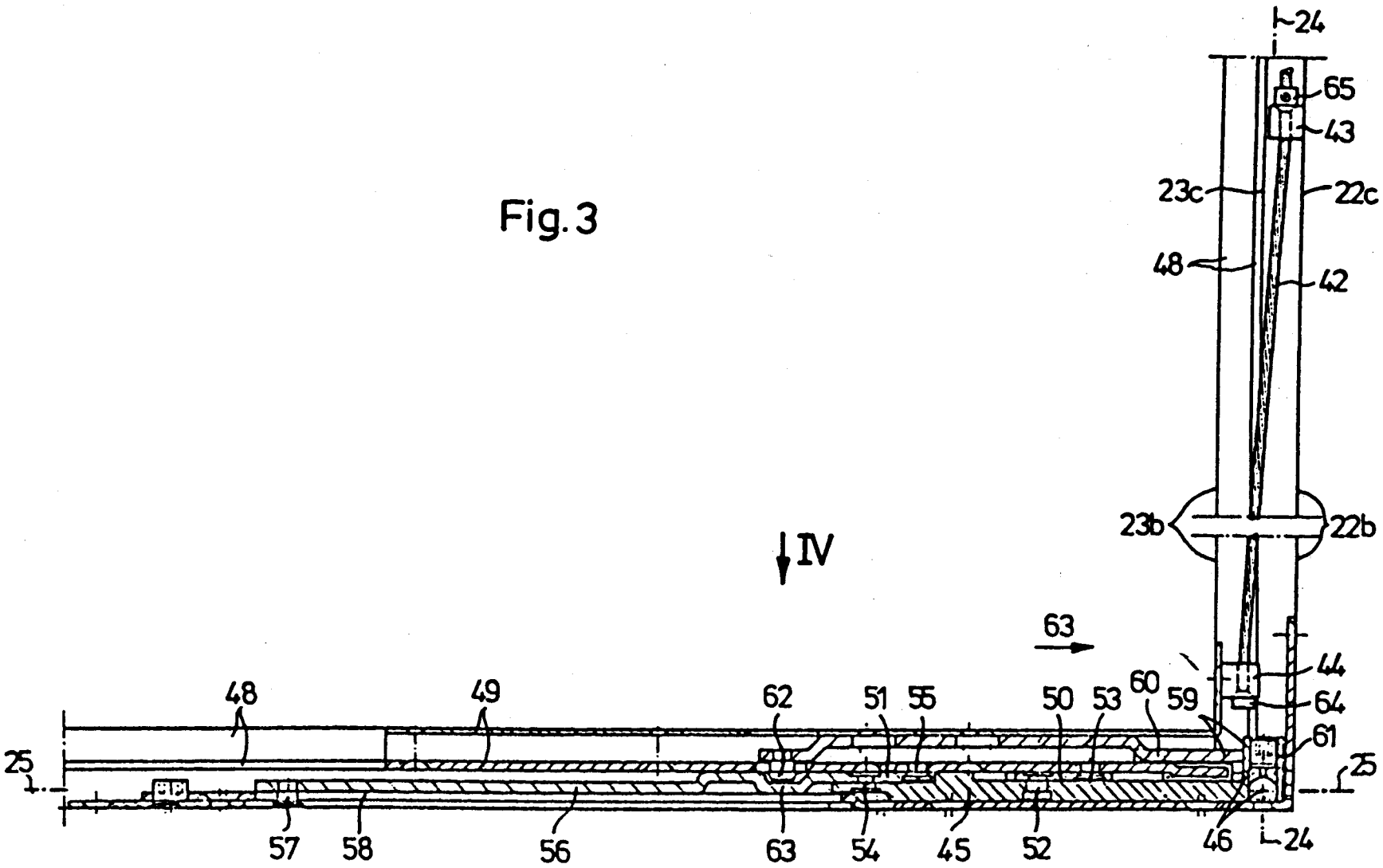
FIG. 3 shows, on a larger scale, a partial cross-section parallel to the plane of the drawing of FIG. 2 through the panel and the fixed frame of the window or the door, with a detailed illustration of a hinge fitting.
Figure 4:
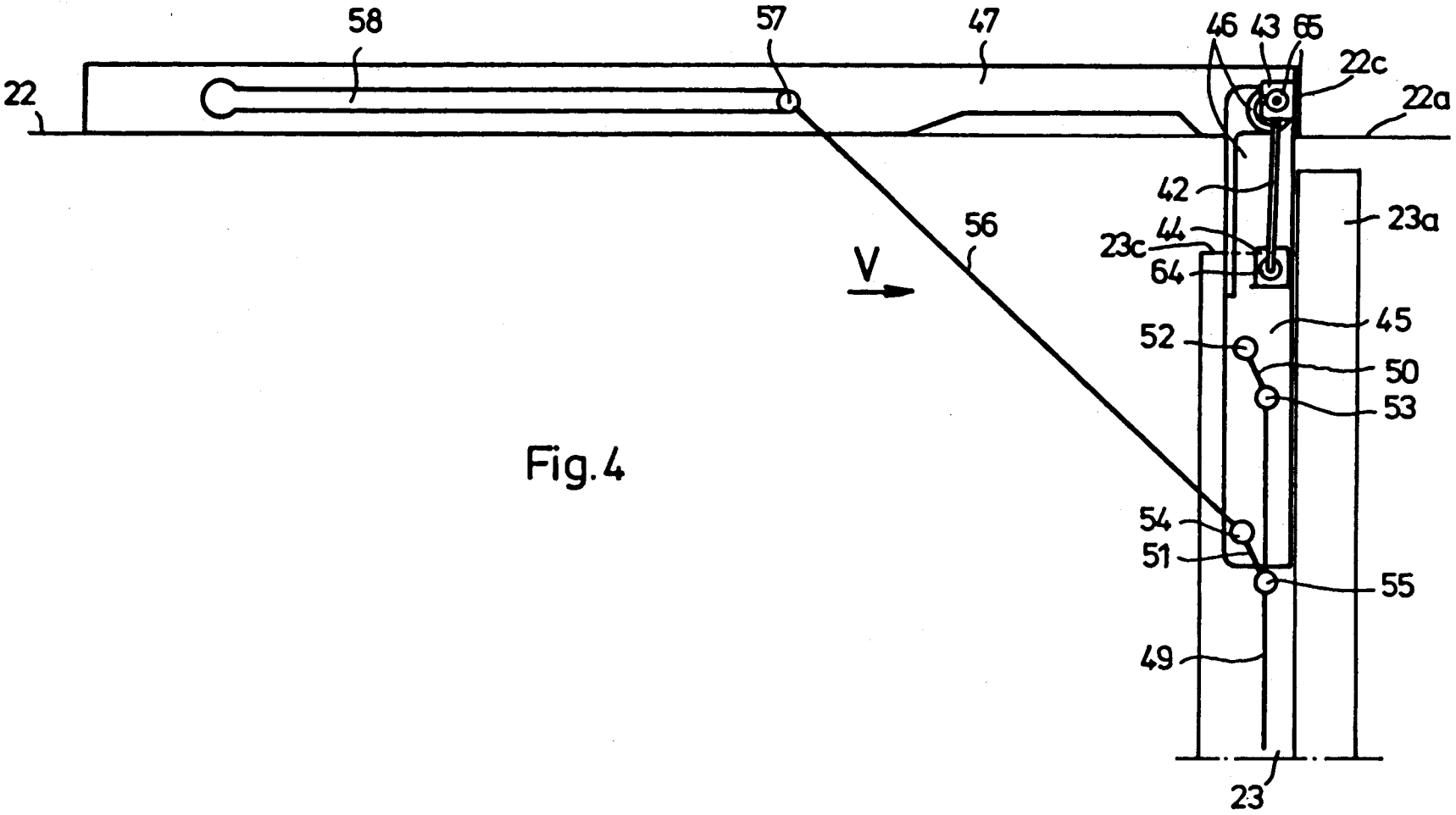
FIG. 4 illustrates in a schematic, simplified manner, a view in the direction of the arrow IV of the window or the door according to FIG. 3, with the panel being opened in the rotated position relative to the fixed frame, FIG. 5 again in schematically simplified illustration, is a view of the window or door in the direction of the arrow V in FIG. 4.
Figure 6:
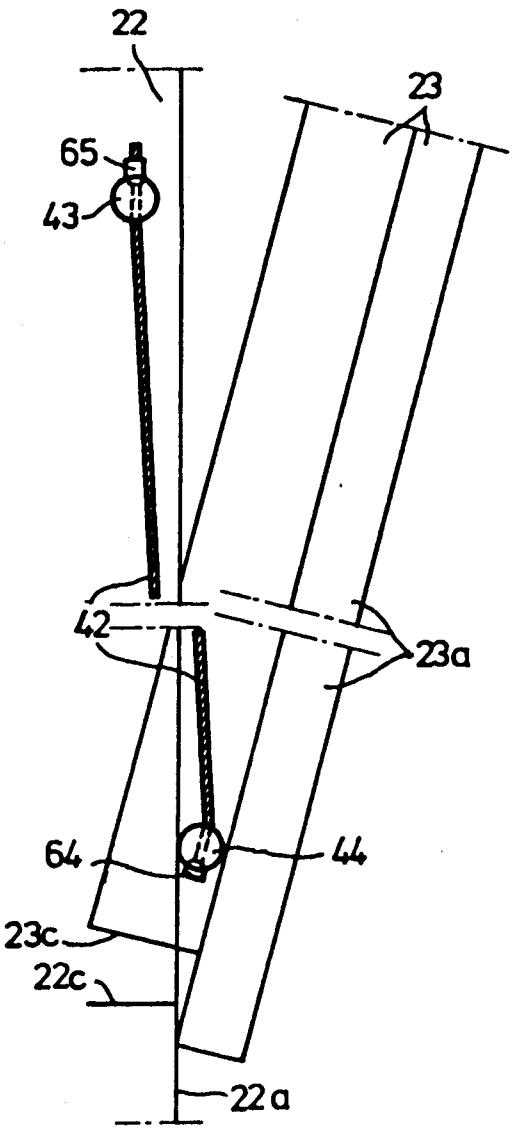
FIG. 6 is a similar, schematically simplified view of the window or door, but with the panel opened in the tilt position relative to the fixed frame.
Figure 5:
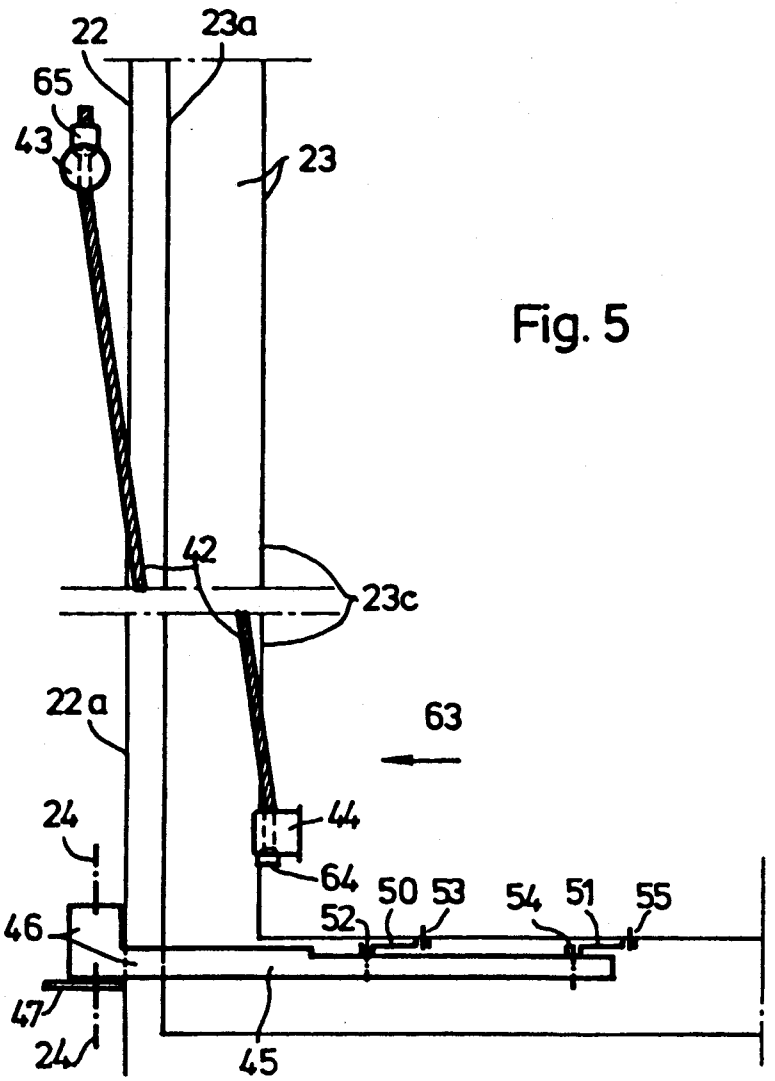

The arrangement, design, and mechanism of action of the brace 42 pursuant to FIG. 2 are shown in FIGS. 3 to 6 of the drawing, which show a window or a door 21 in which the panel 23 is hung on the fixed frame 22 by hinge fittings (corner hinge 26 and hinge 27) which are completely hidden between the horizontal grooves of the panel 23 and the fixed frame 22. The hinge fittings according to FIGS. 3 to 5 are based on a design and mechanism of action that has basically been previously disclosed, for example by British Pat. No. 496 829.

FIG. 3 of the drawing shows the hinge fitting constructed as a corner hinge or tilt corner bearing 26 in a detailed illustration shown in longitudinal cross section. In this case, the bearing has a design that not only permits the panel 23 to be opened by rotating around the vertical axis 24-24, but also supports the panel 23 for tilt opening around the bottom horizontal axis 25-25.

The upper hinge fitting constituting the hinge 27, on the other hand, is part of the ventilator mechanism 28 that holds and guides the panel 23, both in the closed position and also when it is rotated or tilted open.

Both hinge fittings, the corner hinge 26 and the hinge 27, comprise arm and swivel gear that have extensively conforming kinematics. It is clear from FIG. 4 that each arm and swivel gear mechanism has a supporting rod 45 that is held on a fastening rail 47 at one end through a hinge 46, or in FIG. 3 through a ball joint 46, which is fastened rigidly against the circumferential groove surface of the fixed frame 22.

The arm and swivel gear also has a main rod 49 mounted on the circumferential groove surface of the panel 23. It may be, for example, inserted in a recessed profile groove 48 running parallel to its main plane, and it is coupled to the supporting rod 45 by two connecting rods 50 and 51.

The connecting rod 50 is arranged on the supporting rod 45 to pivot exclusively through a pivot pin 52, while it engages with the main rod 49, similarly to pivot only through its pivot pin 53.

Likewise, the connecting rod 51 is arranged to pivot only on the supporting rod 45 by a pivot pin 54, while it is engaged to pivot only on the main rod 49 with a pivot pin 55. The two connecting rods 50 and 51 have the same length between their pivot pins 52, 53 and 54, 55, and so are arranged to form a parallelogram-shaped arm and swivel gear drive with the supporting rod 45 and the main rod 49.

For the positive motion control of each hinge fitting which is composed of a parallelogram-shaped arm and swivel gear drive (corner hinge 26 and hinge 27), a control arm 56 is used that engages rigidly with one of the two connecting rods 50 or 51, preferably the connecting rod 51. On the other hand, the control arm is movable via a slide pin 57 in a slot guide 58 that extends parallel to the main plane of the fixed frame 22 and located in an extension of the screw fastening rail 47.

During the opening and closing motion of the panel 23 around the vertical axis 24-24, positive control of the hinge fittings (corner hinge 26 and hinge 27) is produced using the control arm 56, in such a way that the overshoot **23*a* of the panel cannot collide at any time with the face 22*a* of the fixed frame 22 toward the room, over an opening angle of the panel 23 of at least 90°. The rear surface of the panel overshoot 23*a* rests against the face 22*a* of the window frame 22 on the room side only when the panel 23 comes to rest on the fixed frame 22** in the closed position.

Since adequate sealing pressure against the fixed frame 22 cannot be produced solely by the action of the parallelogram arm and swivel gear constituting the hinge fittings (corner hinge 26 and hinge 27) in the closed position of the panel 23 (particularly in the area of the vertical axis 24-24) there are also special locking mechanisms associated with them. In the area of the upper hinge fitting constituting the hinge 27, these are the couplings 34 and 35 already discussed above in connection with the ventilation mechanism 28.

The locking mechanism in the area of the lower hinge fitting (which is acting as a corner hinge or tilting corner hinge 26) on the other hand, preferably has an arrangement, design, and mechanism of action like that described in detail in German patent application No. P 38 34 388.6-25 (incorporated herein by reference). This locking mechanism 59 as shown in FIG. 3 consists of a locking slider 60 movably guided on the panel 23 and parallel to its plane, and a locking catch 61 fastened to the fixed frame 22. The locking slider 60 has an actuating catch 62 that extends under some circumstances into the path of motion of a control cam 63 located on the control arm 56 of the parallelogram-shaped arm and swivel gear. The actuating catch 62 on the locking slider 60 and the control cam 63 on the control arm 56 are arranged relative to one another so that when the panel 23 approaches the closed position on the fixed frame 22, the actuating catch 62 encounters the control cam 63 before the panel 23 assumes its closed position. By a pressure curve on the control cam 63, comprising an inclined surface, for example, the actuating catch 62 (and through it in turn the locking slider 60) is then moved toward the locking catch 61 during the further closing motion of the panel 23, until the slide is locked behind the catch.

As already indicated schematically in FIG. 2, it can also be seen from FIGS. 3 to 6 of the drawing that the brace 42 is positioned above that hinge fitting which acts as a corner hinge or tilt corner bearing 26, i.e., between the vertical element **22*b* of the fixed frame 22, and the vertical element 23*b* of the panel 23, in such a way that it acts essentially in the direction of the vertical axis 24-24**.

The brace 42 is located in the area of the groove gap between the fixed frame 22 and the panel 23 so that it is completely hidden between the circumferential groove surfaces **22*c* and 23*c* when the panel 23 is in the closed position, as clearly seen from FIG. 3. The brace 42 can be composed of a tension rod of rigid material. Preferably, however, a rope or cable, particularly made of steel wires, or a Bowden wire, is used for the brace 42**.

It is important in any case for the upper end of the brace 42 to be hung on the circumferential groove surface **22*c* of the fixed frame 22 in the stationary support 43, while its lower end is engaged with the support 44 associated with the circumferential groove surface 23*c* of the panel 23. Preferably, the support 44 is placed on the panel 23 at the smallest possible distance above the lower hinge fitting or corner hinge 26, with the brace 42 being kept constantly under tight tension between the two supports 43 and 44 so that it absorbs the vertical component of the weight or load of the panel 23 without the load being born on the hinge fitting 26 in the direction of the axis 24-24. This allows the hinge fitting 26** to have to absorb only forces that result from the horizontal component of the weight or load of the panel 23 and which are oriented normal to the axis 24-24, as indicated in each of FIGS. 3 to 5 by the arrow 63.

In the simplest case, the supports 43 and 44 for the brace 42 can consist of pins with transverse bores or forked slits that are fastened to the circumferential groove surfaces 22c and 23c of the fixed frame 22 and the panel 23. The brace 42 is then introduced into their crossbores or forked slits. The active length of the brace is purposefully exactly dimensioned or is adjustable to the distance between the two supports 43 and 44. The adjustability can be made possible by providing the brace 42 with support stops 64 and 65, at least one of which (for example the support stop 65) constitutes a clamping sleeve that can move in the longitudinal direction of the brace 42 and can be fastened to it in any set position. At least one of the support stops 64 and 65 of the brace 42 could also be designed for smooth adjustment of its active length by using suitable screw elements.

As in the case of the embodiment according to FIG. 1 of the drawing, however, it would also be possible pursuant to FIGS. 2 to 6 to insert spring elements between one of the supports 43 and 44 and the brace 42, whose stress force can be modified as needed. This spring element can be set or adjusted to the particular weight of the panel 23 within certain limits.

As shown in FIGS. 3 to 6 of the drawing, the brace 42 takes different active positions with various positions of the panel 23 relative to the fixed frame 22, but that it nevertheless fulfills its intended function in each case.

The change of length of the brace 42 between its supports 43 and 44 resulting from any motion of the panel 23 relative to the fixed frame 22 can be handled by the present invention. When the brace 42 consists of a rigid material, then for this purpose it only needs to have universal joint or ball joint connections to the supports 43 and 44. However, if the brace 42 is designed to bend (rope, cable, Bowden wire), then it can adjust directly to the motions of the panel 23 relative to the fixed frame 22.

A tension bar can be used as a brace 42 made of rigid material, whose ends are engaged by universal joint or ball joint connecting elements to the fixed frame 22 and to the panel 23, and specifically to the supports 43 and 44 designed to fit them. However, a ribbon-like material susceptible to torsion, particularly spring steel strip, can also be used as the brace 42. Such a ribbon material has the specific advantage that it can have a relatively large width with relatively small thickness, with this width being limited fundamentally by the width of the circumferential groove surfaces of the fixed frame 22 and of the panel 23. It has proved particularly useful for the ribbon material or the spring steel strips to be used with a width that corresponds to sixteen to twenty times its thickness.

In the latter case, it has also turned out to be beneficial for the ribbon material of the brace 42, when the panel 23 rests against the fixed frame 22 in the closed position, to be oriented over its entire length with its wide side at least approximately parallel to the circumferential groove surfaces or perpendicular to the principal planes of the fixed frame 22 and of the panel 23. In this way, in the closed position and during the tilting of the panel 23, only a small installation space is needed. It is stressed in torsion when the panel 23 is turned open around its upright axis 24-24 up through an angle of about 90°.

When the brace 42 consists of a rigid tension rod or a ribbon material susceptible to torsion, it can be set up for smooth adjustment of its active length between the supports 43 and 44, for example using screw elements.

Figure 7:
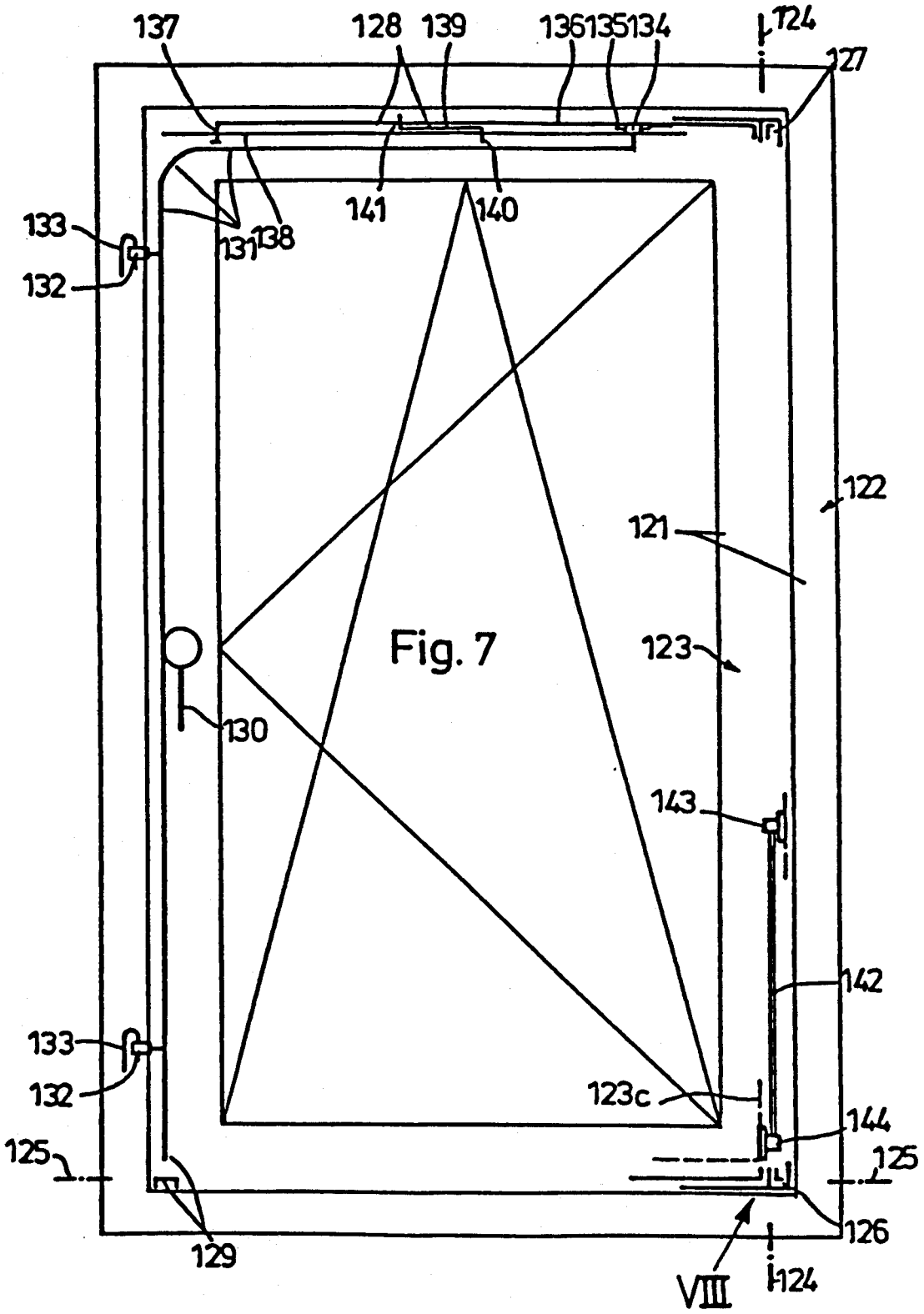
FIG. 7 shows a window or a door in which the panel is fastened as a tilt panel to the fixed frame and the hinge fittings are hidden between the grooves of the panel and frame.

FIG. 7 of the drawing shows a window or a door 121 that comprises a fixed frame 122 and a panel 123. The panel 123 in this case is positioned movably in the fixed frame 122, either around a vertical axis 124-124 into a rotated open position, or around a bottom horizontal axis 125-125 into a tilted Open position. The panel 123 for this purpose is supported by a corner hinge or a tilt corner bearing 126 on the fixed frame 122 at the intersection of the two hinge axes 124-124 and 125-125. There is also a hinge 127 and there is a ventilation mechanism 128 at the top between the panel 123 and the fixed frame, while there is a tilt lock 129 at the bottom closure corner of the panel 123 and the fixed frame 122.

A connecting rod fitting 131 adjustable through an operating handle 130 is provided on the panel 123 in such a way that the panel 123 in the closed position can be locked to and unlocked from the fixed frame 122 by locking cogs 132 and associated locking catches 133. On the other hand, the connecting rod fitting 131 can also be designed so that both a coupling 134, 135 between the panel 123 and the ventilator mechanism 128 and the tilt lock 129 can engaged and disengaged with its assistance. The coupling 134, 135 is in its engaged position between the panel 123 and the ventilation mechanism 128 in both the closed position and in the rotated open position of the connecting rod fitting 131. In the tilted open position of the connecting rod 131, on the other hand, the coupling 134, 135 is disengaged. The tilt lock 129 is in the disengaged position when the connecting rod fitting 131 assumes its closed position and its rotated open position, while it is engaged in the tilted open position.

The ventilation mechanism 128 is constructed as a so-called "supporting" ventilation mechanism, by the elliptical guide principle, i.e., it is suitable for holding the weight of the panel 123 when the connecting rod fitting 131 is in the closed or rotated open position, and for transmitting it into the upper hinge 127 on the window frame side. For this purpose, the ventilation mechanism 128 has a ventilation arm 136 mounted to pivot in the hinge 127 on the frame side, with the ventilator arm engaging at its other end through a press fit pin 137 so that it can pivot and also move longitudinally in a slip guide 138 that extends essentially parallel to the upper edge of the panel 123. The ventilation mechanism 128 also has a supplementary arm 139, which is hinged to pivot exclusively on the panel 123 through a pivot pin 140, and is also connected through a pivot pin 141 to the ventilator arm 136 so that it can only pivot.

The ventilation mechanism 128 is kinematically designed so that it holds the upper panel cap oriented parallel to the upper cap of the fixed frame 122 in every possible tilted position during the opening of the panel 123 by tilting. The hinge fittings 126 and 127 are completely hidden in the air space between the grooves of the panel 123 and the fixed frame 122. Hinge fittings that are based on the so called cross-scissors principle, as disclosed in either U.S. Pat. No. 1 864 164 or U.S. Pat. No. 3 722 142, can be used to constitute the corner hinge or the tilt corner bearing 126 as well as the hinge 127.

To relieve the corner hinge or tilt corner bearing 126 of the vertical component of the weight or load of the panel 123, a brace 142 is used in the window or door 121. It acts in the direction of the vertical hinge axis 124-124, and for this purpose it is hung by its upper end on a stationary support 143 of the fixed frame 122, while its lower end is engaged with a support 144 located on the panel 123. The brace 142 with its supports 143 and 144 is installed entirely above the lower corner hinge or tilt corner bearing 126, but nevertheless very close to it, between the panel 123 and the fixed frame 122, as can be seen clearly from FIG. 7.

The arrangement, design, and mechanism of action of the brace 142 according to FIG. 7 are seen in FIGS. 8, 9, and 10 of the drawing, which show a window or a door 121 in which the panel 123 is hung on the fixed frame 122 by hinge fittings completely hidden between the horizontal grooves, specifically (in FIG. 7) the corner hinge 126 and the hinge 127. FIGS. 8 to 10 of the drawing show only the corner hinge or tilt corner bearing 126, because in connection with the brace 142, the differences to be discussed are only of the particular design of the hinge part 145 of this corner hinge or tilt corner bearing 126 on the panel side.

It is apparent from FIG. 8 that the hinge fitting part 145 on the panel side has the shape of an elbow with two arms 146 and 147 arranged at right angles to one another.. The angular arms 146 and 147 of the hinge fitting part 145 on the panel side are inserted into a recessed profile groove 148 of the circumferential groove surface 149 of the panel 133 so that its outside is flush with the circumferential groove surface 149.

The upright angular arm 147 of the panel fitting part 145 has a hook shoulder 150 projecting beyond the circumferential groove surface of the upright panel cap in the manner of an extension arm with an angular slot 151 open to the side at its bottom end. The hook shoulder 150 is composed of two hook parts 150*a* and 150*b* parallel to the plane of the panel and separated from one another by a spacing gap 150*c*, as shown clearly in FIG. 9.

The brace 142 has a block-shaped enlargement 152 at its bottom end, preferably in the form of a cylindrical or spherical body, in which the brace 142 is either permanently or detachably anchored. The permanent anchoring can be done, for example, by casting or pressing the block-shaped enlargement 152 with the brace 142. For detachable connection, on the other hand, the brace 142 can be inserted into a diametral bore in the block-shaped enlargement and then be fastened by tightening a clamping screw.

The brace 142 with its block-shaped enlargement 152 can be brought into coupling engagement with the hook shoulder 150 via the laterally oriented opening of the angular slot 151, by introducing the brace 142 from the side into the spacing gap 150*c* between the two hook parts 150*a* and 150*b* (FIG. 9). The block- shaped enlargement 152 then fits into the upper end area of the angular slot 151 on the sides of the hook parts 150*a* and 150*b* of the hook shoulder 150, as seen clearly in FIG. 8. The hook shoulder 150 therefore constitutes the support 144 on the panel side according to FIG. 7.

For the brace 142 to be coupled easily to the panel fitting part 145, but to be able to be uncoupled again without a excessive additional manipulation, the angular slot 151 in the hook shoulder 150 is associated with a cam-shaped, tapered projection 153 in the area of its opening pointing to the side or directly above it. This tapered projection 153 preferably consists of a spring tab 154 or a latching catch that is provided on or in the angular arm 147 of the panel fitting part 145, as shown clearly in FIGS. 8 and 9. When the block-shaped enlargement 152 of the brace 142 is engaged in the angular slot 151, the spring tab 154 or the latching catch deforms elastically and thereby opens up the top end area of the hook slot 151 for the entry of the block-shaped enlargement 152. If the enlargement is then engaged in the hook shoulder 150, then the spring tab 154 or the latching catch is automatically reset into its locked position, and grips beneath the block-shaped enlargement 152 while at the same time narrowing the cross section in the hook slot 151. The block-shaped enlargement 152 of the brace 142 can then be released again for removal simply by manually pressing back the spring tab or the latching catch.

In the embodiment according to FIG. 10, the tapered projection 153 is located on the free end of one lever arm of a two-armed lever 155 that is mounted in the upright angular arm 147 of the panel fitting part 145. The lever pivots around an axis 156. The free end of the other lever arm of this two-armed lever 155 carries a controlling or starting cam 157 that is pivoted into the area of the upper end of the angular slot 151 if the tapered projection 153 is located outside of the angular slot 151. When the brace 142 with its block-shaped enlargement 152 is then introduced into the angular slot 151 of the hook shoulder 150, then the block-shaped enlargement 152 strikes at the top against the controlling or starting cam 157 and displaces it from the area of the angular slot 151 on the hook shoulder 150. The tapered projection 153 then engages beneath the block-shaped enlargement 152 in the angular slot 151 and narrows its cross section so that the enlargement 152 can no longer escape from it directly. It should be noted that the two-armed lever 155 is incorporated in the panel fitting part 145 so that it can act in the area of the spacing gap 150*c* between the two hook parts 150*a* and 150*b*.

Clearly, minor changes may be made in the form and construction of this device without departing from the material spirit of the invention. Therefore, it is not desired to confine the invention to the exact forms shown herein and described but it is desired to include all subject matter that properly comes within the scope claimed.

The invention having been thus described what is claimed as new and desired to secure by Letters Patent is:

1. A window or door with a panel mounted on a fixed frame by hinge fittings near a vertical panel element, characterized by a brace engaged with the panel adjacent to the hinge fittings which comprise upper and lower corner hinges and anchored to the fixed frame against the force of gravity or direction of load of the panel wherein the window or door has a tilt panel and further characterized by the fact that the brace is located between the panel and the frame above, but near, the lower corner hinge.

2. A window or door according to claim 1, characterized by the fact that the brace is hung by an upper end on the fixed frame, and engages the panel with its lower end.

3. A window or door according to claim 1, characterized by the fact that the brace is held constantly under tight tensile stress.

4. An window or door according to claim 1 characterized by the fact that the brace comprises a rope, cable, or a Bowden wire.

5. A window or door according to claim 1 characterized by the fact that the brace is hidden in the air space between grooves in the panel and frame.

6. A window or door according to claim 1 characterized by the fact that the brace is adjustable in length.

7. A window or door according to claim 1, characterized by the fact that the brace comprises a tension rod made of rigid material that has universal joint or ball joint connections with the panel and frame.

8. A window or door according to claim 1, characterized by the fact that the brace is carried around a support on the fixed frame, and is placed under tensile stress by a counterforce.

9. A window or door according to claim 1, characterized by the fact that a panel-side part of the hinge fitting has a hook shoulder projecting as a bracket beyond the edge of a vertical panel element and is provided with an angular slot open laterally at its lower end, and by the fact that the hook shoulder has two hook sections parallel to the plane of the panel and separated from one another by a spacing gap, and by the fact that the brace has a block-shaped enlargement at its bottom end whose cross sectional dimension matches the width of the angular slot, while the spacing gap forms a receptacle for the brace, the block-shaped enlargement preferably consisting of a cylindrical or spherical element in which the brace is anchored permanently or detachably, while the panel-side hinge fitting is an angled piece adapted to be inserted in the area of the panel corner by two angled legs into a groove provided on a circumferential groove surface of the panel.

10. A window or door according to claim 9, characterized by the fact that there is a cam-shaped tapered projection associated with the angular slot of the hook shoulder adjacent to the opening with the tapered projection comprising a spring tab or a latch snap, or resting on the free end of a first lever arm of a two-armed lever that is mounted to pivot around an axis on part of the hinge fitting on the panel side and carries a controlling or starting cam at the free end of its other lever arm, that can pivot into the angular slot alternately with the tapered projection.

11. A window or door with a panel mounted on a fixed frame near a vertical panel element by hinge fittings, characterized by the fact that the panel is mounted on the fixed frame as a tilt panel, movable around a vertical hinge axis or around a lower, horizontal hinge axis by the fact that the tilt panel is also held by a brace engaged with it, on the one hand, in the area of the lateral, vertical hinge axis and, on the other hand, anchored to the fixed frame against the force of gravity or direction of load of the tilt panel, and by the fact that the brace is installed between the tilt panel and the frame, above but near the lower corner hinge.

* * * * *